United States Patent [19]

Mansson et al.

[11] 4,118,847

[45] Oct. 10, 1978

[54] METHOD OF ASSEMBLING A TURBO-MACHINE, APPARATUS FOR USE IN THE METHOD, AND TURBO MACHINE CONSTRUCTED ACCORDING TO SAID METHOD

[75] Inventors: Martin Mansson; Ragnar Torstenfelt, both of Finspong, Sweden

[73] Assignee: Stal-Laval Turbin AB, Finspong, Sweden

[21] Appl. No.: 711,667

[22] Filed: Aug. 4, 1976

[30] Foreign Application Priority Data

Aug. 19, 1975 [SE] Sweden ..... 7509230

[51] Int. Cl.[2] ..... B23P 15/00; B23P 19/04

[52] U.S. Cl. ..... 29/156.8 R; 29/23.5; 29/281.6; 269/43

[58] Field of Search ..... 29/156.8 R, 23.5, 281.1, 29/281.6; 269/43, 40, 321 W, 321 A

[56] References Cited

U.S. PATENT DOCUMENTS

| | | | |
|---|---|---|---|
| 2,186,641 | 1/1940 | Jones | 269/43 |
| 2,334,001 | 11/1943 | Hapgood | 269/43 |
| 2,749,026 | 6/1956 | Hasbrouck et al. | 29/156.8 R |
| 3,289,268 | 12/1966 | Bernardis | 269/40 |
| 3,409,970 | 11/1968 | DiPietra | 29/281.6 |
| 3,636,609 | 1/1972 | Stahl | 29/281.1 |
| 4,016,636 | 4/1977 | Schneider et al. | 29/156.8 R |

*Primary Examiner*—C.W. Lanham
*Assistant Examiner*—Daniel C. Crane
*Attorney, Agent, or Firm*—Pollock, Vande Sande & Priddy

[57] ABSTRACT

A method for assembling a turbo-machine of the type comprising a stator housing supporting guide vanes and a rotor having blade discs. According to the method, the stator housing is placed with its axis vertically oriented on a base member which supports the housing both in the vertical and in the horizontal direction. Guide vanes and blade discs are alternately placed in the housing with the guide vanes being secured to the interior of the housing and the blade discs being supported in stacked relationship with interleaved spacing rings on the base member. The stack of blade discs is then secured together as by through bolts passing through aligned apertures in the blade discs. Thereafter, the rotor comprising the assembled blade discs and spacing rings is centered relative to the stator housing. The interconnected stator housing and assembled rotor are then lifted from the base member and moved to a horizontal position. The invention also includes apparatus for interconnecting the rotor and the stator during the assembly operation, and also includes a turbo-machine constructed in accordance with the above-described method.

5 Claims, 2 Drawing Figures

METHOD OF ASSEMBLING A TURBO-MACHINE, APPARATUS FOR USE IN THE METHOD, AND TURBO MACHINE CONSTRUCTED ACCORDING TO SAID METHOD

BACKGROUND OF THE INVENTION

The present invention relates to a method of assembling a turbo-machine of the type comprising a stator housing supporting guide vanes and a rotor having blade discs. The invention further relates to apparatus for interconnecting the rotor and the stator during assembly and also relates to a turbo-machine manufactured in accordance with the method.

The manufacture of large turbo machines in accordance with prior art methods results in certain problems resulting from the size and housing of the parts which are used in the construction of the machine and resulting also from the need for a high degree of precision in the assembly process.

SUMMARY OF THE INVENTION

According to the present invention, the assembly of a turbo-machine, particularly large machines having an undivided stator housing, is facilitated by carrying out the assembly while the machine is positioned with its axis in a vertical direction. By assembling a machine in this manner, the stability of the machine is increased and the cost of assembly is considerably reduced.

BRIEF DESCRIPTION OF THE DRAWINGS

In describing the invention, reference will be made to the accompanying drawings in which.

DETAILED DESCRIPTION OF THE PREFERRED EMBODIMENTS

Figure 1:
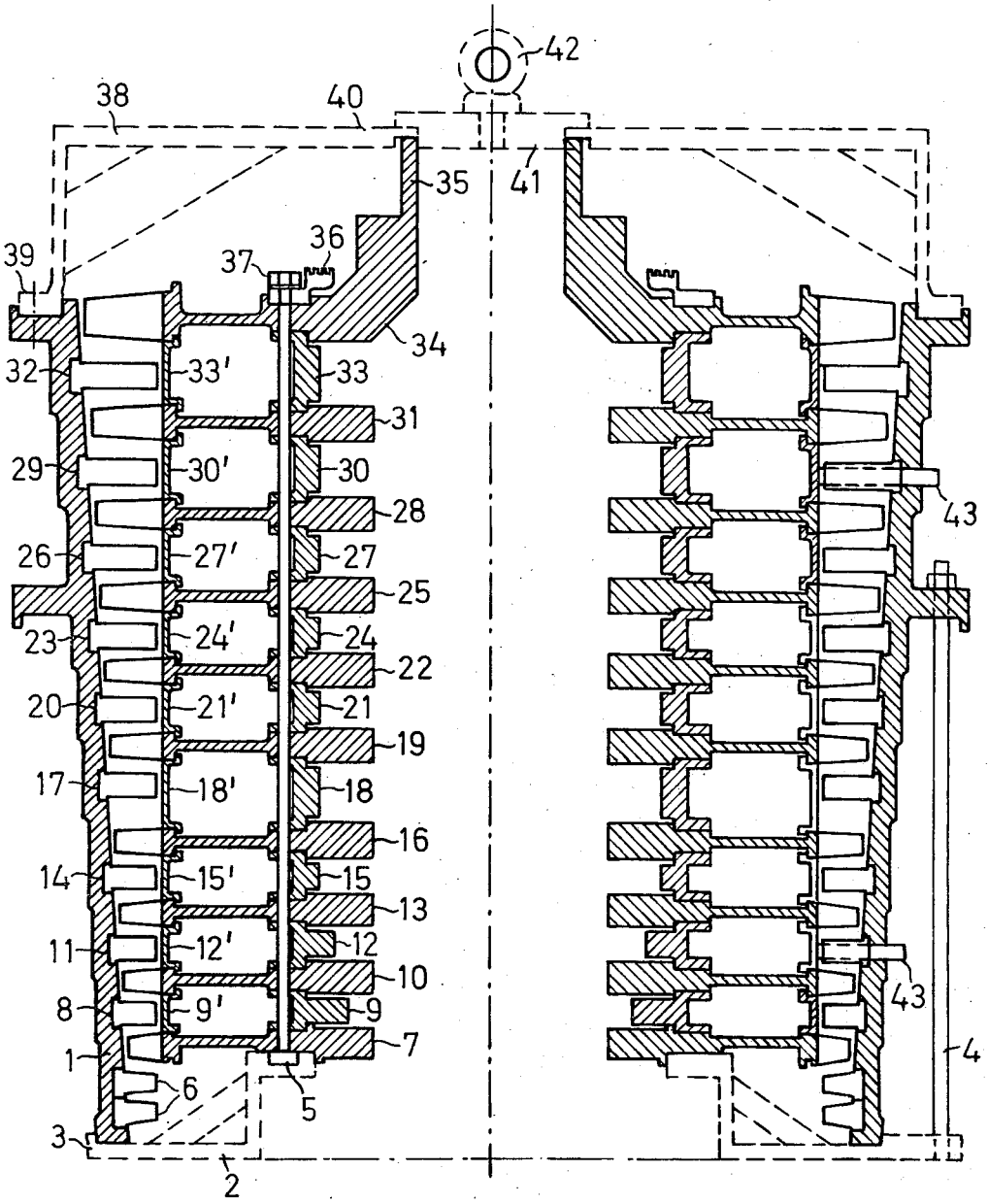
FIG. 1 is an axial cross-sectional view of a turbo-machine during assembly with its axis vertically oriented.

As shown in FIG. 1, the stator housing 1 is placed with its axis vertically upon a base 2 which may, for example, be provided with an edge or flange 3 which fits around the lower edge of the stator housing. The stator housing may be suitably braced onto the base 2 by means of bolts 4. At approximately the same time, axial bolts 5 are placed on the base 2, preferably with their heads fitting into recesses formed in the base 2 and suitably positioned and spaced to receive such bolt heads. The bolts 5, which are intended to secure together the various elements comprising the rotor, may be positioned in place together with the first rotor disc 7. Of course, prior to this, the lowermost set of guide vanes 6 should have been fixed in position in the stator; however, these guide vanes can be positioned at the end of the assembly operation when the finished machine has been removed from the base 2.

Figure 2:
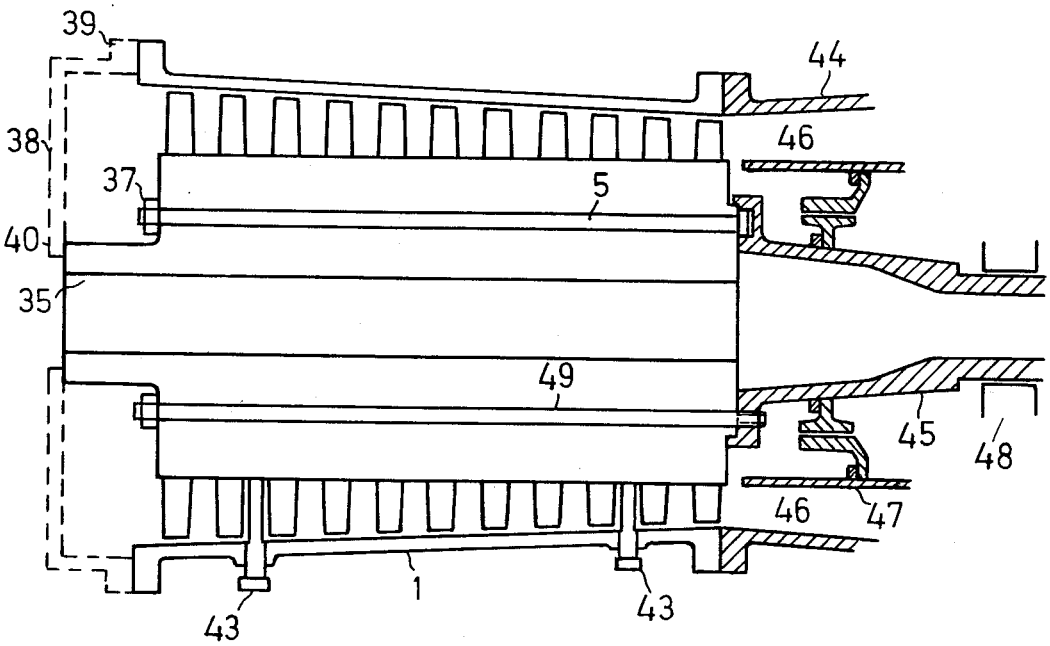
FIG. 2 illustrates a cross-sectional view of the turbo-machine of FIG. 1 with its axis in the horizontal direction for coupling to another rotary machine.

In the embodiment shown, the rotor comprises rotor discs 7, 10, 13, etc. and spacing rings 9, 12, 15, etc., and with the spacing rings being interleaved between the rotor discs. The several elements which together form the rotor are held together by axial bolts 5 and 49 as shown in FIG. 2. The rotor has no axial shaft passing therethrough, and this makes it possible for the shaft of another machine, coaxial with the rotor, to be passed through the rotor.

When the components 1–5 have been set into place as described above, the blade grid of the machine can be bladed together. More specifically, the guide vanes 6, 8, 11, 14, etc. of the stator, the rotor wheels 7, 10, 13, 16, etc., and the spacing rings 9, 12, 15, etc. are placed in position one at a time. The uppermost rotor wheel 34 is provided with a hub which ends in a shaft pin 35. A sealing ring 36 to provide a labyrinth seal can be placed on top of the rotor wheel 34, and the elements of the rotor are then clamped together by means of the nuts 37 which threadably engage with the bolts 5. The inner spacing rings 9, 12, 15, etc. may be supplemented with outer spacing rings 9′, 12′, 15′, etc.

After the rotor has been assembled in the stator housing, the rotor may be properly centered relative to the stator housing by means of radial support bolts 43 which are screwed in through the stator housing so that they press against the rotor, for example, against the outer spacing rings thereof. The stator and the rotor may then be fixed in relation to each other by means of a lid-like tool 38, the outer edge of which fits and is bolted together with the upper edge of the stator housing, the inner edge 40 being bolted to the rotor pin 35. At the same time, a flange 41 with an eye bolt 42 can be bolted to the edge 40 so that the entire assembled machine can be lifted. Prior to lifting the assembled machine, of course, the bolts 4 between the stator and the base are removed, with the machine then being lifted up and tilted to a horizontal position to enable it to be coupled to another machine as shown in FIG. 2.

The turbo-machine of FIG. 2 has been somewhat simplified, but the essential parts thereof are shown as comprising the stator housing 1, the rotor which is retained in its assembled state by the bolts 5, the lid 38 which retains the stator and rotor, and the radial support bolts.

FIG. 2 illustrates only a portion of the other machine which is intended to be coupled to the machine manufactured in accordance with the method of this invention, and thus there is shown only a stator housing 44 of such other machine and its shaft end 45.

The turbo-machine according to the invention may, for example, be a turbo compressor which provides compressed air which is pressed into an annular channel 46 between the stator housing 44 and a cylindrical wall 47. From the channel 46, the compressed air may, for example, be fed to one or more combustion chambers for a gas turbine which drives the turbo-compressor over the shaft end 45 which is journalled in bearing 48.

After the two machines have been brought together in the horizontal direction, the two stator housings 1 and 44 can be clamped together by means of flange joints as shown. Thereafter, the rotor is clamped to the shaft end 45 by means of axial bolts 49 which are screwed into a flange on the shaft end. This flange is suitably provided with apertures or recesses for the heads of the other bolts 5 which are thus able to transmit torque between the rotors of the two machines. It is thus clear that the bolts 5 have the function of retaining the several elements forming the rotor during assembly thereof, whereas the bolts 49 are provided to retain the two rotors in coupled relationship during operation and loading. The bolts 5 can therefore be relatively few in number, with perhaps only half as many bolts 5 being provided as there are bolts 49.

When the stator housings and the rotors have been coupled together, the lid 38 and the support bolts 43 may be removed, and an end portion of the stator housing 1 with a bearing for the shaft pin 35 may then be mounted whereafter the machine is substantially ready for operation.

The method of assembly disclosed herein thus provides a convenient construction and method of assembling particularly for large machines having undivided stator housings. It will be apparent that the apparatus required for the assembly of the machine in accordance with the method of this invention, i.e. the base 2, the lid-like member 38, and the radial support bolts 43, are all quite simple in relation to the machine.

What we claim is:

1. A method for assembling a turbo-machine of the type comprising a stator housing supporting guide vanes and a rotor having blade discs comprising the steps of:

placing the stator housing with its axis vertical upon a base member which supports said housing both in the vertical and horizontal direction, alternately positioning guide vanes and blade discs in said housing with the guide vanes being secured to the interior of the hosing and with the blade discs being supported in stacked relationship with interleaved spacing rings on said base member, securing together the stack of blade discs, adjustably centering the rotor comprising the assembled blade discs and spacing rings relative to the stator housing, interconnecting the uppermost ends of the stator housing and rotor, lifting the interconnected stator housing and rotor from the base member and moving them to a horizontal position, removing said base member, and coupling the rotor of said assembled and horizontally aligned turbo-machine to a rotor of a further horizontally aligned rotary machine by passing a plurality of rotor coupling bolts through aligned apertures in the blade discs and spacing rings of said turbo-machine rotor and also through apertures in a part of the rotor of said further machine.

2. The method of claim 1 in which said centering step is accomplished by passing radially directed support elements through said stator housing to abut against and urge the rotor into a centered position.

3. The method of claim 1 in which during said securing step a plurality of rotor assembly bolts is passed through aligned apertures in the blade discs and spacing rings.

4. Apparatus for the assembly of the rotor and stator of a turbo-machine of the type wherein the stator housing supports guide vanes and the rotor comprises a stack of interleaved blade discs and spacing rings and wherein the rotor is assembled in the stator housing with the stator housing vertically oriented and the completed assembly is subsequently moved to a horizontal position, comprising;

a horizontal base member for supporting said vertically oriented stator housing in an engaged relation to said rotor assembly and including means for blocking the horizontal movement of said engaged stator and rotor, adjusting means passing radially through the wall defining said housing for abutment against the rotor to permit centering of the rotor relative to said housing, and means for releasably interconnecting the top of the stator housing and the top of the rotor subsequent to assembly of the rotor in said housing.

5. The apparatus of claim 4 which further includes means for releasably securing said stator housing to said base member.

* * * * *